US011918086B2

(12) United States Patent
Cho et al.

(10) Patent No.: US 11,918,086 B2
(45) Date of Patent: Mar. 5, 2024

(54) METHOD FOR PRODUCING SHOE SOLE

(71) Applicant: YOUNG CHANG ECO CO., LTD., Busan (KR)

(72) Inventors: Hwi Joon Cho, Busan (KR); Jae Young Cho, Busan (KR)

(73) Assignee: YOUNG CHANG ECO CO., LTD., Busan (KR)

( * ) Notice: Subject to any disclaimer, the term of this patent is extended or adjusted under 35 U.S.C. 154(b) by 339 days.

(21) Appl. No.: 17/424,094

(22) PCT Filed: Aug. 26, 2019

(86) PCT No.: PCT/KR2019/010856
§ 371 (c)(1),
(2) Date: Jul. 19, 2021

(87) PCT Pub. No.: WO2020/262757
PCT Pub. Date: Dec. 30, 2020

(65) Prior Publication Data

US 2022/0117359 A1 Apr. 21, 2022

(30) Foreign Application Priority Data

Jun. 25, 2019 (KR) ..... 10-2019-0075421

(51) Int. Cl.
*A43D 8/02* (2006.01)
*A43B 1/00* (2006.01)
(Continued)

(52) U.S. Cl.
CPC ..... *A43D 8/02* (2013.01); *A43B 1/0009* (2013.01); *A43B 13/122* (2013.01); *A43B 13/125* (2013.01); *A43B 13/32* (2013.01)

(58) Field of Classification Search
CPC ..... A41B 13/122; A41B 13/125; A41B 13/32; A41B 13/023; A41B 13/12; A41B 13/14;
(Continued)

(56) References Cited

U.S. PATENT DOCUMENTS 3,812,604 A * 5/1974 Sato ..... A43B 9/18 12/142 RS
5,367,791 A * 11/1994 Gross ..... A43B 13/26 36/31

(Continued)

FOREIGN PATENT DOCUMENTS

KR 20-0376979 Y1 3/2005
KR 10-2006-0125989 A 12/2006
KR 10-2013-0093982 A 8/2013

OTHER PUBLICATIONS

International Search Report for PCT/KR2019/010856 dated Mar. 20, 2020 from Korean Intellectual Property Office.

*Primary Examiner* — Megan E Lynch
*Assistant Examiner* — Giao Qt Hoang
(74) *Attorney, Agent, or Firm* — Paratus Law Group, PLLC

(57) ABSTRACT

Disclosed is a method for producing a shoe sole. The shoe sole includes: a shoe sole fabric having the form of a sole; a protective cover having the form corresponding to the form of the shoe sole fabric and bonded to a lower surface of the shoe sole fabric with a plurality of pillar through holes vertically penetrating the protective cover; and a plurality of pillar pieces passing through the plurality of pillar through holes, and bonded to the lower surface of the shoe sole fabric and arranged in a form of protruding downward from the protective cover.

4 Claims, 8 Drawing Sheets

(51) Int. Cl.
*A43B 13/12* (2006.01)
*A43B 13/32* (2006.01)

(58) Field of Classification Search
CPC ..... A41B 13/16; A41B 13/02; A43D 8/02; A43B 9/00
See application file for complete search history.

(56) References Cited

U.S. PATENT DOCUMENTS

| | | | | |
|---|---|---|---|---|
| 7,451,557 | B2 | 11/2008 | McDonald et al. | |
| 2010/0307025 | A1 | 12/2010 | Truelsen et al. | |
| 2013/0276333 | A1* | 10/2013 | Wawrousek | A43B 13/141 36/102 |
| 2015/0250259 | A1* | 9/2015 | Attey | A43B 3/128 36/103 |
| 2015/0289586 | A1* | 10/2015 | Wan | A43B 13/16 36/31 |
| 2015/0313312 | A1* | 11/2015 | Park | A43B 13/16 36/31 |
| 2016/0101583 | A1* | 4/2016 | Shiao | A43D 25/18 156/251 |

* cited by examiner

METHOD FOR PRODUCING SHOE SOLE

CROSS-REFERENCE TO PRIOR APPLICATIONS

This application is a National Stage Patent Application of PCT International Patent Application No. PCT/KR2019/010856 (filed on Aug. 26, 2019) under 35 U.S.C. § 371, which claims priority to Korean Patent Application No. 10-2019-0075421 (filed on Jun. 25, 2019), which are all hereby incorporated by reference in their entirety.

BACKGROUND

The present disclosure relates to a method for producing a shoe sole constituting a lower portion of a shoe.

Shoes are provided in various ways according to specific purposes, and recently, the functionality of shoes is emphasized and shoes have become specialized. Also, shoes are recognized as an important fashion accessory, so the design of shoes is important.

Shoes may be classified into various types such as dress shoes, sneakers, hiking shoes, slippers, and other special purpose shoes, and these shoes consist of similar components, but may have differences according to the use of each shoe.

In general, sneakers may consist of an upper, an outsole, a midsole, and an insole, slippers may consist of an upper covering only the instep portion and a single shoe sole. In other words, the shoe sole of slippers may be a single-body shoe sole without distinction between the outsole, the midsole, and the insole.

The outsole, the midsole, and the insole have different functions, and therefore are made of different materials. The outsole is made of rubber as a main material to serve a function of contacting with the ground and preventing sliding.

The midsole is made of materials such as foamed urethane or EVA to serve a function of impact absorption, and the insole is made of a material having a thickness thinner than the midsole and coupled to felt at an upper portion thereof to remove foot odor or to absorb sweat.

Meanwhile, when the midsole or the outsole is produced, a dedicated mold suitable for the design thereof may be used. As described above, the conventional method of producing a shoe sole needs expensive production costs and has limitation in design change.

Furthermore, the conventional midsole is generally formed one element, so the flexibility of the midsole depends only on a material of the midsole.

SUMMARY

Accordingly, the present disclosure has been made keeping in mind the above problems occurring in the related art, and an objective of the present disclosure is to provide a method for producing a shoe sole having a new structure capable of variously designing the form of the shoe sole, and capable of flexibly bending the shoe sole with a plurality of pillar pieces that are independently arranged while being bonded to a shoe sole fabric. In order to accomplish the above objective, according to an embodiment of the present disclosure, a method for producing a shoe sole includes: preparing plates to be cut out, wherein the plates are a flat plate for a pillar piece with a first thickness and a flat plate for a protective cover with a second thickness thinner than the first thickness; forming a first laminate, wherein the plate for a protective cover is disposed on an upper surface of the plate for a pillar piece, and the plate for a pillar piece and the plate for a protective cover are cut out, such that the plate for a pillar piece is divided into a plurality of first pieces of cut material and a first remaining portion of cut material and the plate for a protective cover is divided into a plurality of second pieces of cut material and a second remaining portion of cut material, and the plurality of second pieces of cut material has the same form and arrangement as a form and arrangement of the plurality of first pieces of cut material; forming a second laminate, wherein the first laminate is seated on a laminate seating plate which has a plurality of protrusions for a piece of cut material protruding on an upper surface thereof with the same form and arrangement as the form and arrangement of the plurality of first pieces of cut material such that the first pieces of cut material of the first laminate are located above the protrusions for a piece of cut material, the first pieces of cut material and the second pieces of cut material are moved upward by the protrusions for a piece of cut material in a state in which the first remaining portion of cut material and the second remaining portion of cut material are seated on the laminate seating plate to move upward upper surfaces of the first pieces of cut material to the same level as an upper surface of the second remaining portion of cut material, and the second pieces of cut material moved upward are removed to form the second laminate which is the first laminate without the plurality of second pieces of cut material; forming a fabric-bonded laminate, wherein a pre-cut fabric is bonded to an upper portion of the second laminate to form the fabric-bonded laminate in which the first pieces of cut material and the second remaining portion of cut material of the second laminate are bonded to a lower surface of the pre-cut fabric; forming a cut material for an insole, wherein the fabric-bonded laminate is cut in a vertical direction thereof to be divided into the cut material for an insole and an outer remaining portion of cut material, the cut material for an insole having a plan of a form of a sole and with the first pieces of cut material being located inside the cut material for an insole and the outer remaining portion of cut material being located outside the cut material for an insole; and separating a shoe sole, wherein the cut material for an insole is separated from the outer remaining portion of cut material to obtain the shoe sole comprising the cut material for an insole by separating.

In the forming the first laminate, the plate for a protective cover may be disposed on the upper surface of the plate for a pillar piece, and then the first pieces of cut material, the first remaining portion of cut material, the second pieces of cut material, and the second remaining portion of cut material are formed simultaneously by a single cutting.

In the forming the fabric-bonded laminate, the pre-cut fabric having a lower surface temporarily bonded to a thermal adhesive film may be disposed on the upper portion of the second laminate, and the first pieces of cut material and the second remaining portion of cut material are heat-welded to the pre-cut fabric with the thermal adhesive film.

The plate for a pillar piece may have a form in which an upper midsole plate for a pillar piece and a lower outsole plate for a pillar piece may be bonded to each other.

As described above, the present disclosure adopts the form in which the plurality of pillar pieces is bonded to the shoe sole fabric to provide the shoe sole with a flexible structure, and the present disclosure does not need a separate mold. Accordingly, the new type method for producing a shoe sole can be provided so that the shoe sole can have the various designs and the production costs thereof can be reduced.

DETAILED DESCRIPTION

Figure 1:
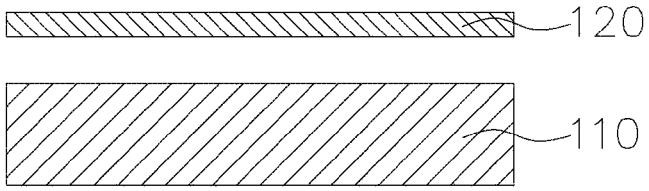
FIG. 1 is a sectional view showing a plate for a pillar piece and a plate for a protective cover according to a first embodiment of the present disclosure.

Hereinbelow, exemplary embodiments of the present disclosure will be described in detail with reference to the accompanying drawings such that the invention can be easily embodied by one of ordinary skill in the art to which the present disclosure belongs. However, the present disclosure may be embodied variously and is not limited to the embodiment described hereinbelow. Throughout the drawings, components incorporated herein will be omitted when it may make the subject matter of the present disclosure unclear, the same reference numerals will refer to the same or like parts.

Unless the context clearly indicates otherwise, it will be further understood that the terms "comprises", "comprising", "includes", and/or "including", when used herein, specify the presence of stated features, integers, steps, operations, elements, and/or components, but do not preclude the presence or addition of one or more other features, integers, steps, operations, elements, components, and/or groups thereof.

First, a method for producing a shoe sole according to a first embodiment of the present disclosure will be described.

Figure 2:
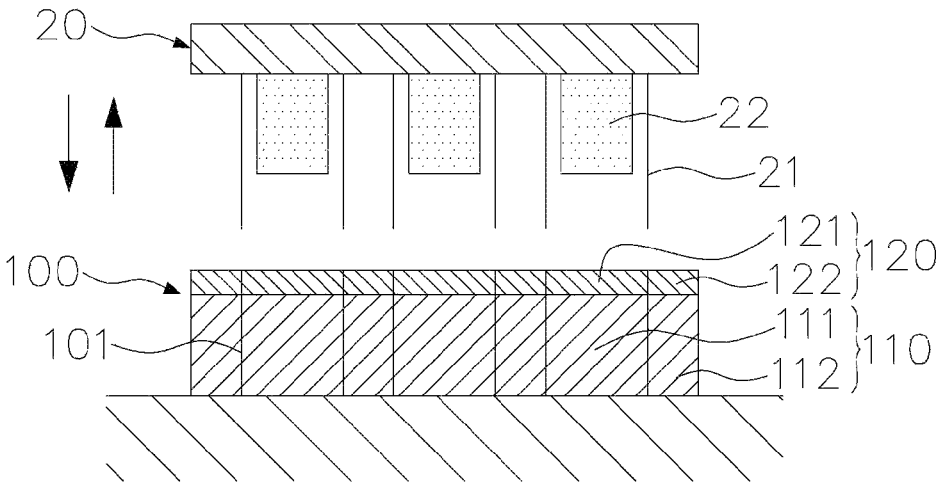
FIG. 2 is a view showing forming a first laminate.
Figure 3:
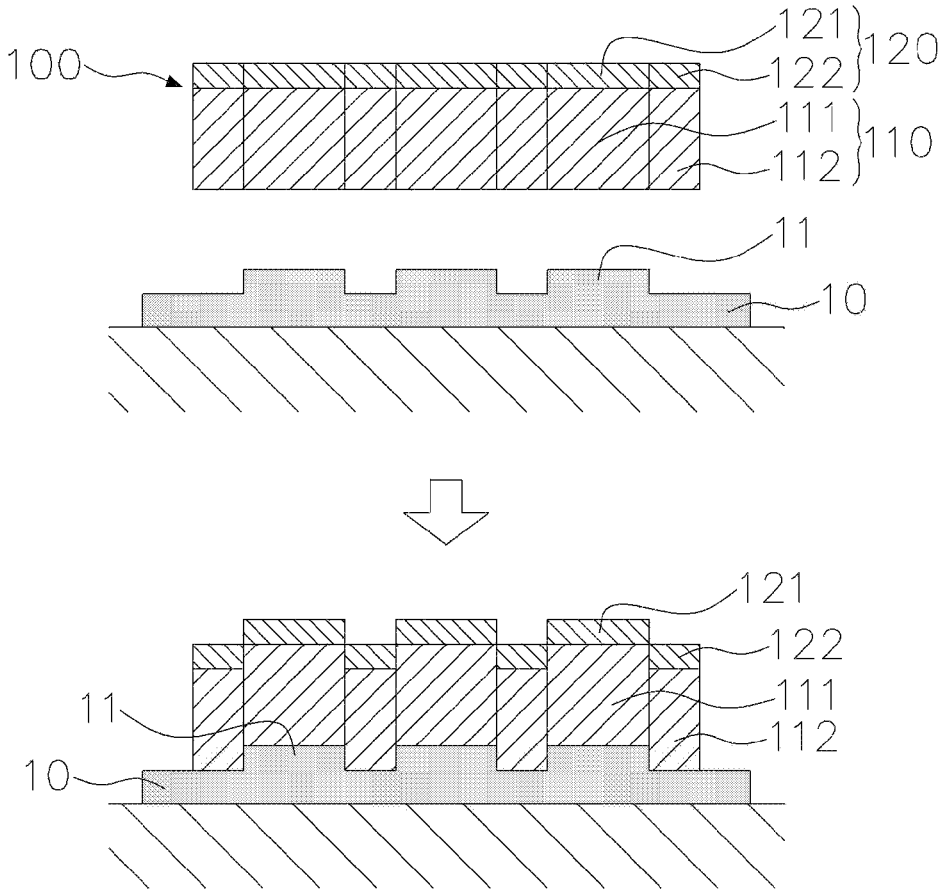
FIGS. 3 and 4 are views showing forming a second laminate.
Figure 4:
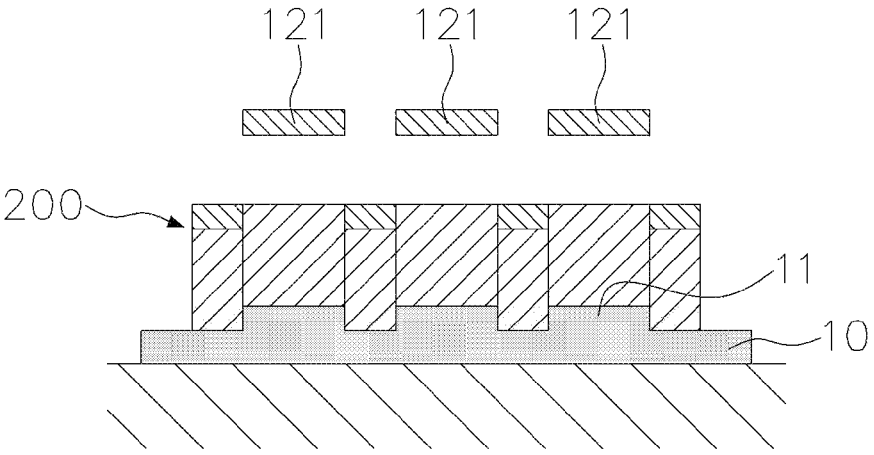
Figure 5:
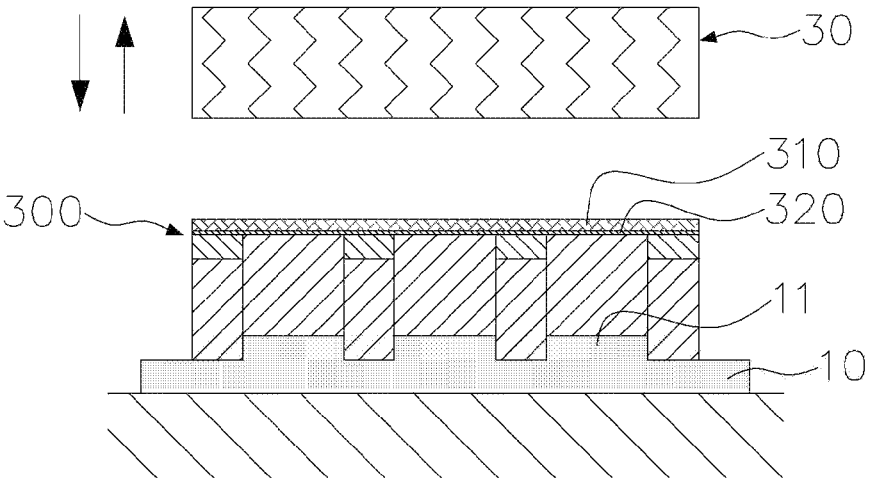
FIG. 5 is a view showing forming a fabric-bonded laminate.
Figure 6:
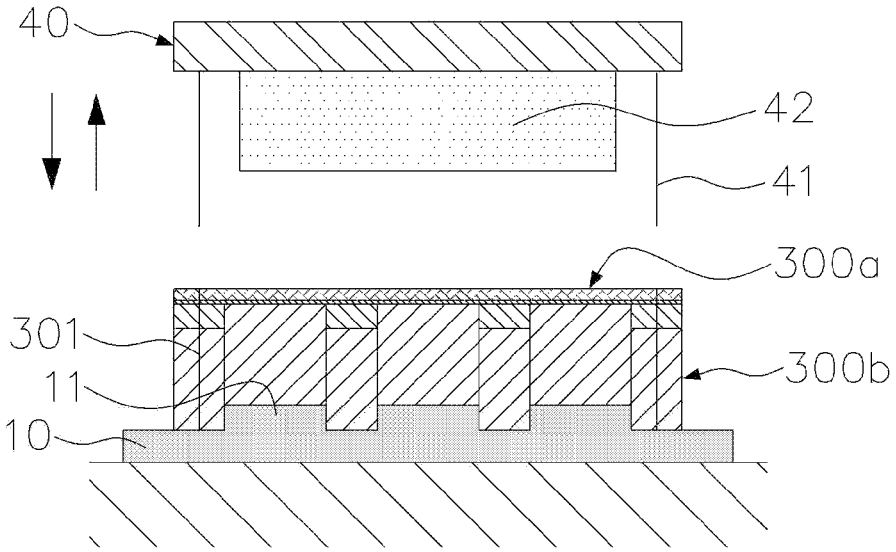
FIG. 6 is a view showing forming a cut material for an insole by cutting out the fabric-bonded laminate.
Figure 7:
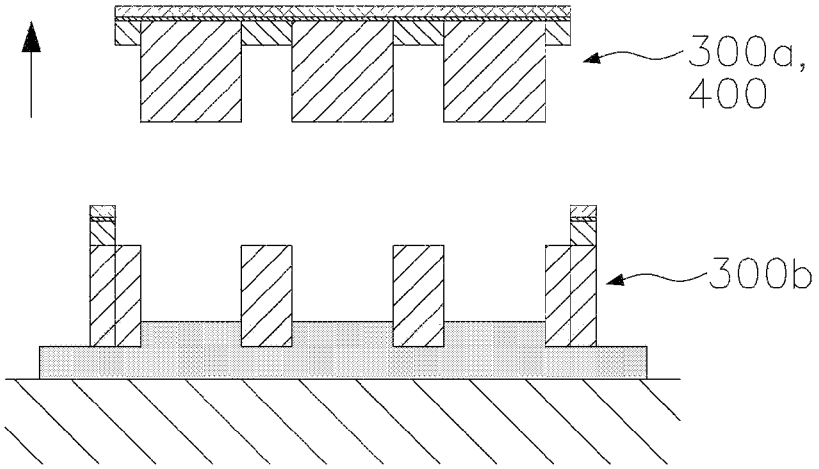
FIG. 7 is a view showing separating a shoe sole that is the cut material for an insole.
Figure 8:
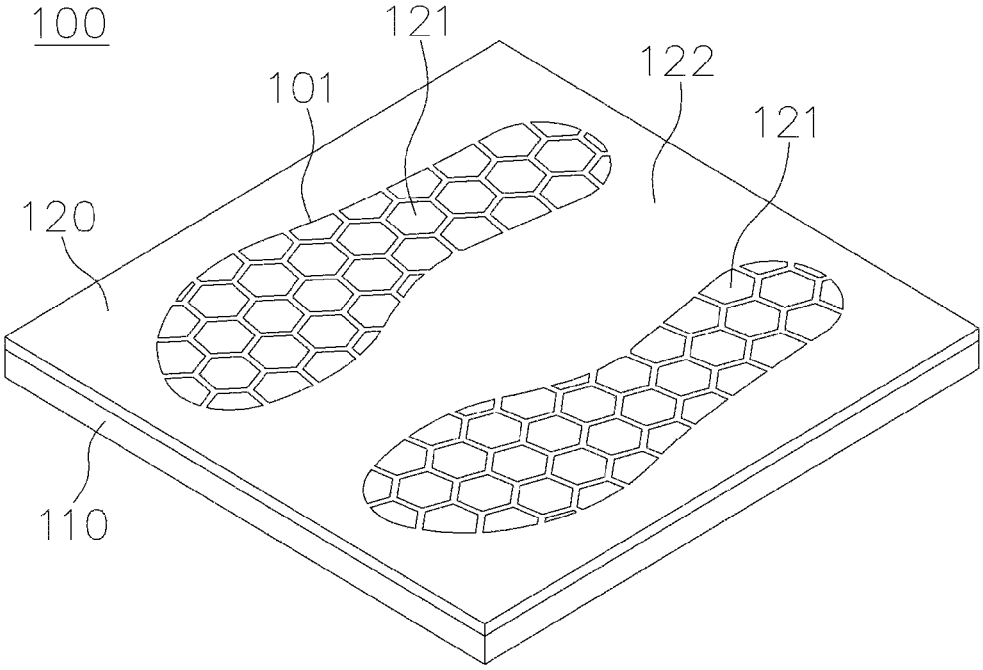
FIG. 8 is a perspective view showing the first laminate in FIG. 2.
Figure 9:
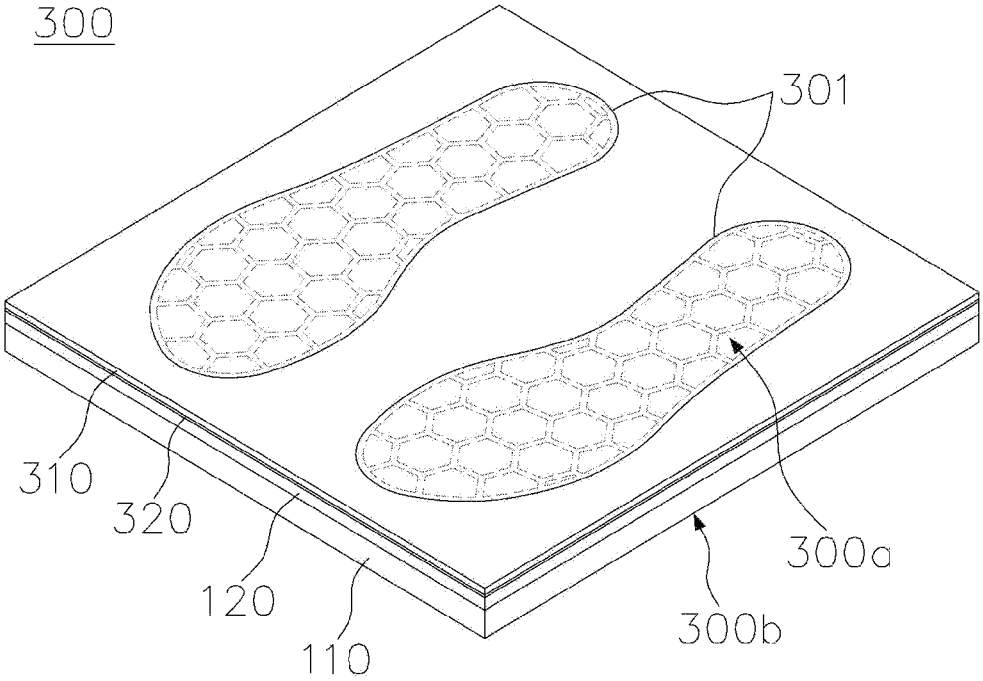
FIG. 9 is a perspective view showing the fabric-bonded laminate that has been cut out in FIG. 6.
Figure 10:
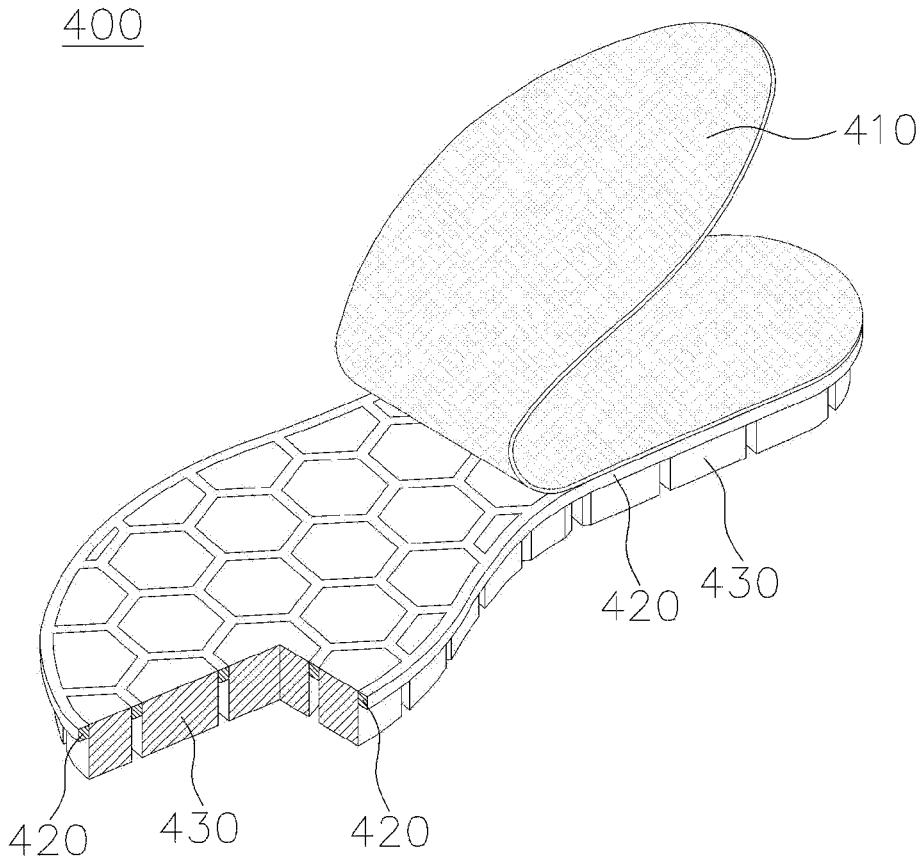
FIG. 10 is a partially cut perspective view showing the shoe sole that has been obtained in FIG. 7.
Figure 11:
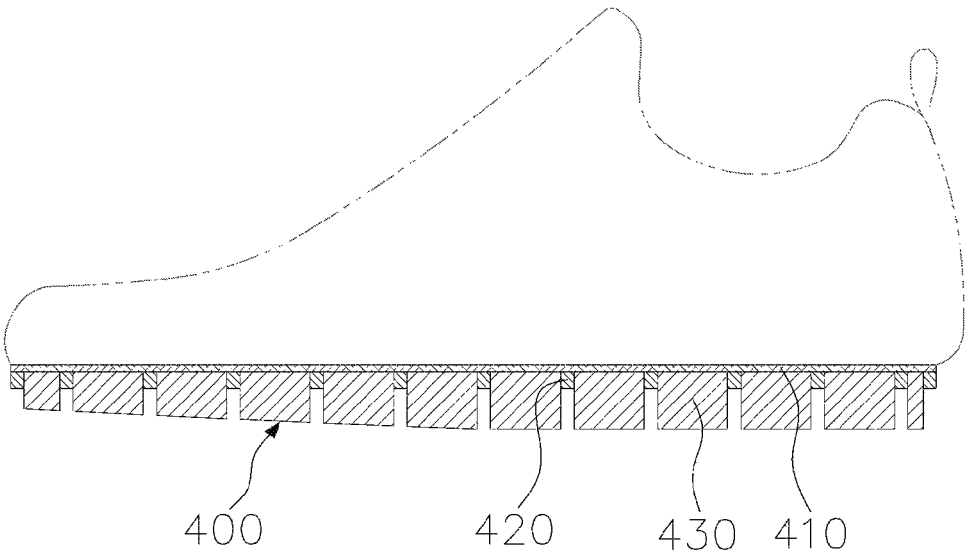
FIG. 11 is a sectional concept view showing a shoe using the shoe sole in FIG. 10.

FIG. 1 is a sectional view showing a plate for a pillar piece and a plate for a protective cover according to a first embodiment of the present disclosure. FIG. 2 is a view showing forming a first laminate. FIGS. 3 and 4 are views showing forming a second laminate. FIG. 5 is a view showing forming a fabric-bonded laminate. FIG. 6 is a view showing forming a cut material for an insole by cutting out the fabric-bonded laminate. FIG. 7 is a view showing separating a shoe sole that is the cut material for an insole. FIG. 8 is a perspective view showing the first laminate in FIG. 2. FIG. 9 is a perspective view showing the fabric-bonded laminate that has been cut out in FIG. 6. FIG. 10 is a partially cut perspective view showing the shoe sole that has been obtained in FIG. 7. FIG. 11 is a sectional concept view showing a shoe using the shoe sole in FIG. 10.

1. Preparing Plate to be Cut Out

As shown in FIG. 1, a pair of plates to be cut out is prepared. The pair of plates to be cut out is a plate to be cut out by a cut processing, which will be described later, the pair of plates have a rectangular plate form in the embodiment.

As the plates to be cut, a plate 110 for a pillar piece and a plate 120 for a protective cover are prepared.

The plate 110 for a pillar piece is a part for providing pillar pieces 430 of a shoe sole 400 to be described later. The plate 120 for a protective cover is a part for providing a protective cover 420 of the shoe sole 400.

In the embodiment, the plate 110 for a pillar piece is polyurethane foam and the plate 120 for a protective cover is ethylene-vinyl acetate (EVA) foam, but these materials are just an example, and the material thereof may be variously changed.

The plate 110 for a pillar piece has a first thickness and the plate 120 for a protective cover has a second thickness thinner than the first thickness.

2. Forming First Laminate

As shown in FIG. 2, the plate 120 for a protective cover is disposed on an upper portion of the plate 110 for a pillar piece, and then the plates are vertically cut out by a first press cutter 20 having a plurality of cutting blades 21 and a plurality of auxiliary cushions 22 to form a first laminate 100 having first cut surfaces 101.

With one vertical cut processing, the plate 110 for a pillar piece and the plate 120 for a protective cover are cut out simultaneously. The plate 110 for a pillar piece is divided into a plurality of first pieces 111 of cut material and a first remaining portion 112 of cut material by the plurality of first cut surfaces 101, and the plate 120 for a protective cover is divided into a plurality of second pieces 121 of cut material and a second remaining portion 122 of cut material by the plurality of first cut surfaces 101.

The plate 110 for a pillar piece is in a state to be separated into the first pieces 111 of cut material and a first remaining portion 112 of cut material, but has not yet been separated, and the plate 120 for a protective cover is also in the same state as the plate 110 for a pillar piece.

The plurality of second pieces 121 of cut material has the same form and arrangement as the form and arrangement of the first pieces 111 of cut material, and the second remaining portion 122 of cut material has the same form as the form of the first remaining portion 112 of cut material.

The first pieces 111 of cut material are a part to be the pillar pieces 430 of the shoe sole, and the first remaining portion 112 of cut material is an unnecessary part.

Conversely, the plurality of second pieces 121 of cut material is an unnecessary part, and the second remaining portion 122 of cut material is a part to be the protective cover 420 of the shoe sole.

To perform the above cut processing, the first press cutter 20 has the cutting blades 21 with the same form and arrangement as the form and arrangement of the first pieces 111 of cut material, and the auxiliary cushions 22 are respectively provided in the cutting blades 21.

The cutting blades 21 are provided to form a cut surface having a closed curve planar form, the auxiliary cushions 22 are provided to prevent the first pieces 111 of cut material from being moved upward with the cutting blades 21 when the first press cutter 20 is moved downward and then upward to be separated from the plate 110 for a pillar piece.

In some embodiments, the plate 110 for a pillar piece may be cut out to form the plurality of first pieces 111 of cut material and the first remaining portion 112 of cut material and the plate 120 for a protective cover may be cut out differently from the plate 110 for a pillar piece to form the plurality of second pieces 121 of cut material and the second remaining portion 122 of cut material. Then, the plate 110 for a pillar piece and the plate 120 for a protective cover may be laminated to each other to form the first laminate 100.

The form of the first pieces 111 of cut material may be variously changed.

FIG. 8 is a perspective view showing the first laminate 100 cut out as described above.

3. Forming Second Laminate

As shown in FIGS. 3 and 4, the plurality of second pieces 121 of cut material is removed from the first laminate 100 to form a second laminate 200.

For forming the second laminate 200, a laminate seating plate 10 is prepared.

The laminate seating plate 10 according to the embodiment of the present disclosure has a plurality of protrusions 11 for a piece of cut material on an upper surface thereof. The plurality of protrusions 11 for a piece of cut material has the same form and arrangement as the form and arrangement of the first pieces 111 of cut material.

As shown in FIG. 3, the first laminate 100 is seated on the laminate seating plate 10, so that the first pieces 111 of cut material of the first laminate 100 are located on the protrusions 11 for a piece of cut material of the laminate seating plate 10.

The first pieces 111 of cut material and the plurality of second pieces 121 of cut material are moved upward by the protrusions 11 for a piece of cut material, as the first remaining portion 112 of cut material and the second remaining portion 122 of cut material are seated on the laminate seating plate 10.

Upper surfaces of the first pieces 111 of cut material are moved upward to the same level as an upper surface of the second remaining portion 122 of cut material, and the plurality of second pieces 121 of cut material is separated from the second remaining portion 122 of cut material.

The protrusions 11 for a piece of cut material of the laminate seating plate 10 has a protruding height corresponding to the thickness of the plurality of second pieces 121 of cut material.

Then, as shown in FIG. 4, when the plurality of second pieces 121 of cut material is removed, the second laminate 200 that is the first laminate 100 without the plurality of second pieces 121 of cut material is formed.

3. Forming Fabric-Bonded Laminate

As shown in FIG. 5, a pre-cut fabric 310 is bonded to an upper portion of the second laminate 200 to form a fabric-bonded laminate 300 where the plurality of first pieces 111 of cut material of the second laminate 200 and the single second remaining portion 122 of cut material are bonded to the pre-cut fabric 310.

In the embodiment, after the pre-cut fabric 310 having a lower surface to which a thermal adhesive film 320 temporarily adheres is prepared, the pre-cut fabric 310 is disposed on the upper portion of the second laminate 200. Then, a fusion splicer 30 is used to heat-weld the first pieces 111 of cut material and the second remaining portion 122 of cut material to the pre-cut fabric 310 with the thermal adhesive film 320.

It is enough to choose a flat material as the pre-cut fabric 310, and fabrics, cloth, etc. may be used as the material.

4. Forming Cut Material for Insole

As shown in FIG. 6, a second press cutter 40 having a cutting blade 41 and an auxiliary cushion 42 is used to vertically cut out the fabric-bonded laminate 300, and the fabric-bonded laminate 300 has to form second cut surfaces 301 to form a cut material 300*a* for an insole.

When the fabric-bonded laminate 300 is cut out vertically relative to the fabric-bonded laminate 300 to form the second cut surfaces 301 in the fabric-bonded laminate 300, the fabric-bonded laminate 300 is divided into the cut material 300*a* for an insole and an outer remaining portion of cut material 300*b*.

The cut material 300*a* for an insole has the form of a sole in the plan view, and the plurality of first pieces 111 of cut material is located at a portion inside the cut material 300*a* for an insole. The cut material 300*a* for an insole is a portion for providing the shoe sole 400.

The outer remaining portion of cut material 300*b* is located at a portion outside cut material 300*a* for an insole, and the portion is unnecessary.

To perform the cut processing, the second press cutter 40 has the cutting blade 41 of the form of a sole, and the auxiliary cushion 42 is provided inside the cutting blade 41.

In the embodiment, it is shown that the second remaining portion 122 of cut material is cut out and as well as the first remaining portion 112 of cut material is cut out together by the cut processing. However, in practice, it is enough that the second remaining portion 122 of cut material is cut out by the cut processing and the first remaining portion 112 of cut material does not need to be cut out.

FIG. is a perspective view showing the fabric-bonded laminate 300 that has been cut out. As shown in FIGS. 6 and 9, the plurality of first cut surfaces 101 is located inside the second cut surfaces 301.

5. Separating Shoe Sole

As shown in FIG. 7, the cut material 300*a* for an insole is separated from the outer remaining portion of cut material 300*b* to obtain the shoe sole 400 consisting of the cut material 300*a* for an insole.

FIG. 7 is the separating the shoe sole 400 (i.e., the cut material 300*a* for an insole) after FIG. 6.

According to the producing method as described above, the shoe sole 400 may be produced as shown in FIGS. 10 and 11.

FIG. 10 is a perspective view taken by cutting a portion of the protective cover 420 and portions of the pillar pieces 430 while partially raising a shoe sole fabric 410.

FIG. 11 is a sectional concept view of a shoe to which the shoe sole 400 of the present disclosure is applied.

The shoe sole 400 consists of the shoe sole fabric 410, the protective cover 420, and the plurality of pillar pieces 430.

The shoe sole fabric 410 has the form of a sole. The shoe sole fabric 410 is a portion formed by cutting the pre-cut fabric 310 and may be freely changed in the form.

A bottom of an upper is fixed to the shoe sole fabric 410, and an insole may be further provided at an upper portion of the shoe sole fabric 410.

The protective cover 420 has the form of a sole corresponding to the shoe sole fabric 410 and bonded to a lower surface of the shoe sole fabric 410 with a plurality of pillar through holes formed vertically.

The protective cover 420 is a portion formed by cutting out the second remaining portion 122 of cut material of the plate 120 for a protective cover. The protective cover 420 is a portion cut with the first cut surfaces 101 and the second cut surfaces 301, and has the plurality of pillar through holes by removing the plurality of second pieces 121 of cut material cut with the first cut surfaces 101.

The pillar pieces 430 are bonded to the lower surface of the shoe sole fabric 410 while passing through the pillar through holes of the protective cover 420. In addition, the pillar pieces 430 are arranged in a form of protruding downward from the protective cover 420.

The pillar pieces 430 are portions corresponding to the first pieces 111 of cut material of the plate 110 for a pillar piece.

The shoe sole 400 has the form in which the plurality of pillar pieces 430 is bonded to the shoe sole fabric 410 independently of each other. Therefore, the flexibility of the shoe sole 400 of the present disclosure depends on the shoe sole fabric 410 and the shoe sole 400 is very flexible.

In addition, the protective cover 420 protects the shoe sole fabric 410 from the outside of the shoe and supports an upper structure of the pillar pieces 430 to improve the structural stability of the shoe.

Hereinbelow, a second embodiment of the present disclosure will be described.

Figure 12:
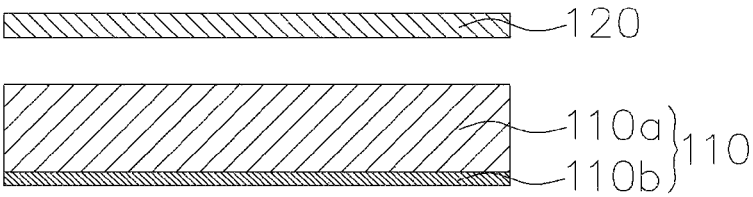
FIG. 12 is a sectional view showing a plate for a pillar piece and a plate for a protective cover according to a second embodiment of the present disclosure.
Figure 13:
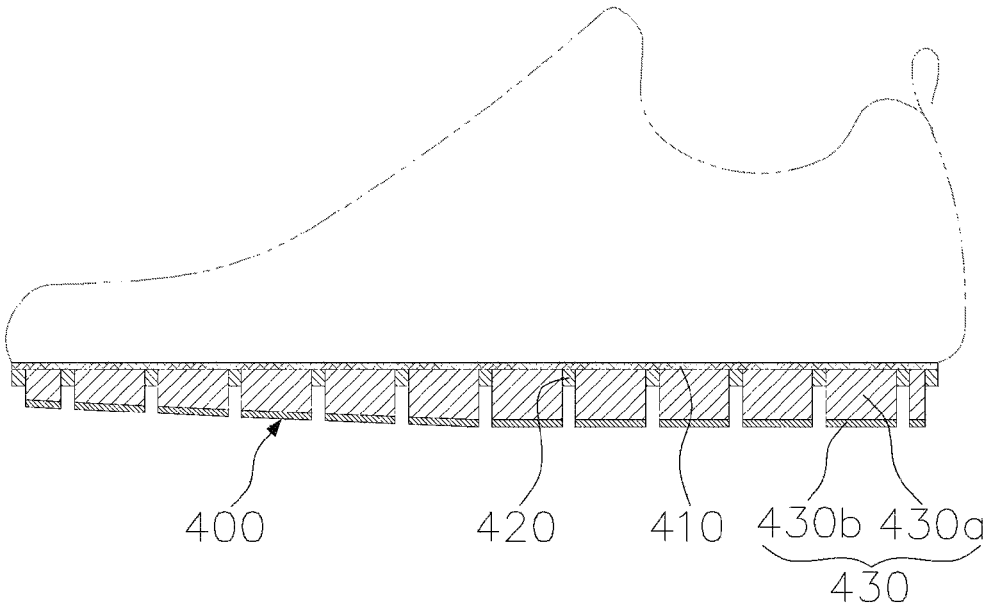
FIG. 13 is a concept sectional view showing a shoe using a shoe sole according to the second embodiment of the present disclosure.

FIG. 12 is a sectional view showing a plate for a pillar piece and a plate for a protective cover applied to the second embodiment of the present disclosure, and FIG. 13 is a sectional concept view of a shoe to which a shoe sole produced according to the second embodiment is applied.

As shown in the drawings, the plate 110 for a pillar piece of the second embodiment consists of an upper midsole plate 110*a* for a pillar piece and a lower outsole plate 110*b* for a pillar piece that are bonded to each other.

The midsole plate 110*a* for a pillar piece is a conventional general midsole material, and the outsole plate 110*b* for a pillar piece is a conventional outsole material.

When the shoe sole is produced according to the manufacturing method of the present disclosure by using the plate 110 for a pillar piece, each of the pillar pieces 430 of the shoe sole 400 has the form in which an upper midsole pillar piece 430*a* and a lower outsole pillar piece 430*b* are bonded to each other, as shown in FIG. 13.

The present disclosure may variously change materials of the pre-cut fabric 310 and the shoe sole fabric 410.

In addition, the present disclosure may variously change materials of the plate 110 for a pillar piece and the pillar pieces 430.

In addition, the present disclosure may variously change materials of the plate 120 for a protective cover and the protective cover 420.

The present disclosure may have various pattern designs and may be variously designed in the structure thereof.

Each of the independent pillar pieces 430 may be manufactured using various materials, and materials having different physical properties, such as elasticity and hardness, may be applied on the basis of various colors.

Each of the independent pillar pieces 430 may be designed with different heights.

The plate 110 for a pillar piece of the present disclosure may be designed to have different materials, colors, and thicknesses for each portion, so that each of the independent pillar pieces 430 may have the different materials, colors, and thicknesses.

Although the preferred embodiments of the present disclosure have been described for illustrative purposes, and those skilled in the art will appreciate that various modifications, additions and substitutions are possible, without departing from the scope and of the present disclosure as disclosed in the accompanying claims. Therefore, it should be understood that the embodiments are not limited to the description hereinabove. For example, each elements described in a single form may be embodied in a dispersal form, and components as being dispersed may be embodied in a coupled form.

The scope of the present disclosure is defined by the accompanying claims rather than the description which is presented above. Moreover, the present disclosure is intended to cover not only the exemplary embodiments, but also various alternatives, modifications, equivalents and other embodiments that may be included within the spirit and scope of the present disclosure as defined by the appended claims.

The present disclosure may be used to manufacture a shoe sole.

The invention claimed is:

1. A method for producing a shoe sole, the method comprising:

preparing plates to be cut out, wherein the plates are a flat plate for a pillar piece with a first thickness and a flat plate for a protective cover with a second thickness thinner than the first thickness;

forming a first laminate, wherein the plate for a protective cover is disposed on an upper surface of the plate for a pillar piece, and the plate for a pillar piece and the plate for a protective cover are cut out, such that the plate for a pillar piece is divided into a plurality of first pieces of cut material and a first remaining portion of cut material and the plate for a protective cover is divided into a plurality of second pieces of cut material and a second remaining portion of cut material, and the plurality of second pieces of cut material has a same shape and position as a shape and position of the plurality of first pieces of cut material;

forming a second laminate, wherein the first laminate is seated on a laminate seating plate which has a plurality of protrusions for a piece of cut material protruding on an upper surface thereof with the same shape and position as the shape and position of the plurality of first pieces of cut material such that the first pieces of cut material of the first laminate are located above the protrusions for a piece of cut material, the first pieces of cut material and the second pieces of cut material are moved upward by the protrusions for a piece of cut material in a state in which the first remaining portion of cut material and the second remaining portion of cut material are seated on the laminate seating plate to move upward upper surfaces of the first pieces of cut material to the same level as an upper surface of the second remaining portion of cut material, and the second pieces of cut material moved upward are removed to form the second laminate which is the first laminate without the plurality of second pieces of cut material;

forming a fabric-bonded laminate, wherein a pre-cut fabric is bonded to an upper portion of the second laminate to form the fabric-bonded laminate in which the first pieces of cut material and the second remaining portion of cut material of the second laminate are bonded to a lower surface of the pre-cut fabric;

forming a cut material for an insole, wherein the fabric-bonded laminate is cut in a vertical direction thereof to be divided into the cut material for an insole and an outer remaining portion of cut material, the cut material for an insole having a plan of a form of a sole and with the first pieces of cut material being located inside the cut material for an insole and the outer remaining portion of cut material being located outside the cut material for an insole; and separating a shoe sole, wherein the cut material for an insole is separated from the outer remaining portion of cut material to obtain the shoe sole comprising the cut material for an insole by separating.

2. The method of claim 1, wherein in the forming the first laminate, the plate for a protective cover is disposed on the upper surface of the plate for a pillar piece, and then the first pieces of cut material, the first remaining portion of cut material, the second pieces of cut material, and the second remaining portion of cut material are formed simultaneously by a single cutting process.

3. The method of claim 1, wherein in the forming the fabric-bonded laminate, the pre-cut fabric having a lower surface temporarily bonded to a thermal adhesive film is disposed on the upper portion of the second laminate, and the first pieces of cut material and the second remaining portion of cut material are heat-welded to the pre-cut fabric with the thermal adhesive film.

4. The method of claim 1, wherein the plate for a pillar piece has a form in which an upper midsole plate for a pillar piece and a lower outsole plate for a pillar piece are bonded to each other.

* * * * *